US006478156B1

(12) United States Patent
Gebhardt

(10) Patent No.: US 6,478,156 B1
(45) Date of Patent: Nov. 12, 2002

(54) HEADERLESS BAG PACK WITH EASY REMOVAL OPENING

(75) Inventor: Terry D. Gebhardt, Longview, TX (US)

(73) Assignee: TC Manufacturing Co., Inc., Evanston, IL (US)

( * ) Notice: Subject to any disclaimer, the term of this patent is extended or adjusted under 35 U.S.C. 154(b) by 561 days.

(21) Appl. No.: 08/965,288

(22) Filed: Nov. 6, 1997

(51) Int. Cl.[7] ..... B65D 1/34

(52) U.S. Cl. ..... 206/554; 206/806; 383/9; 383/37

(58) Field of Search ..... 206/554, 806; 383/7, 9, 26, 37

(56) References Cited

U.S. PATENT DOCUMENTS

| | | | | |
|---|---|---|---|---|
| 888,653 A | | 5/1908 | Potter | |
| 1,883,108 A | * | 10/1932 | Thompson | 206/554 |
| 2,751,734 A | | 6/1956 | Ratliff | |
| 3,211,293 A | * | 10/1965 | Tarnoff | 206/554 |
| 3,348,760 A | | 10/1967 | Hinsken | |
| D213,479 S | | 3/1969 | Williams | |
| 3,616,991 A | | 11/1971 | Beck | |
| 3,763,627 A | | 10/1973 | Kupcikevicius et al. | |
| 3,979,494 A | | 9/1976 | Ericson | |
| 4,015,917 A | | 4/1977 | Ericson | |
| 4,175,603 A | | 11/1979 | Iaboni et al. | |
| 4,595,389 A | | 6/1986 | Lehmacher | |
| 4,669,251 A | * | 6/1987 | Inagaki | 206/554 |
| 4,715,728 A | | 12/1987 | Sfikas | |
| 4,903,839 A | * | 2/1990 | Mattiebe et al. | 206/554 |
| 4,904,092 A | * | 2/1990 | Campbell et al. | 383/35 |
| 4,989,732 A | | 2/1991 | Smith | |
| D317,563 S | | 6/1991 | Spry | |
| 5,087,234 A | | 2/1992 | Prader et al. | |
| 5,323,909 A | | 6/1994 | Piraneo et al. | |
| 5,441,345 A | | 8/1995 | Garvey et al. | |
| 5,467,572 A | | 11/1995 | Wile et al. | |
| 5,507,713 A | | 4/1996 | Glod, Sr. et al. | |
| 5,561,967 A | * | 10/1996 | Nguyen | 53/452 |
| 5,575,393 A | * | 11/1996 | Gebhardt | 206/554 |
| 5,576,037 A | | 11/1996 | Moore, Jr. et al. | |
| D376,538 S | | 12/1996 | Rojnik et al. | |
| 5,590,784 A | | 1/1997 | Daniels | |
| 5,630,779 A | | 5/1997 | Glod et al. | |
| 5,655,682 A | * | 8/1997 | Hoffrichter | 206/554 |
| 5,662,225 A | * | 9/1997 | Demattels | 206/554 |
| 5,669,504 A | * | 9/1997 | Leone et al. | 206/554 |
| 5,690,229 A | * | 11/1997 | Piraneo et al. | 206/554 |

* cited by examiner

*Primary Examiner*—Shian Luong
(74) *Attorney, Agent, or Firm*—Welsh & Katz, Ltd.

(57) ABSTRACT

A headerless pack of thermoplastic film bags having weak bag to bag seals to make said pack and a teardrop like shaped supporting opening whereby said pack is supported on a dispenser rod through said opening and a single bag can easily be removed by pulling down on said bag thereby breaking said seals and tearing through said opening.

16 Claims, 1 Drawing Sheet

HEADERLESS BAG PACK WITH EASY REMOVAL OPENING

BACKGROUND OF THE INVENTION

1. Field of the Invention

The present invention relates to bag packs of thermoplastic film type bags wherein conventionally used headers are avoided. The bag pack is designed to eliminate the waste which is a part of headered bags and to provide an easy support and removal of the bags from a bag holder.

2. Background of the Invention

Plastic bags are used for numerous items, many in the food and hardware field and the like. It is very common to buy these plastic bags in headered bag packs which are then supported on a dispenser. The header is attached to the dispenser by holes or other means and a line of weakening is provided for tearing the bag off the header and thereby removing it for use. Such a construction is shown in Daniels U.S. Pat. No. 5,590,784. This construction, of course, leaves the plastic bag header when the bag pack is depleted. The header is then simply discarded. Since the plastic film to make the bag costs money, the plastic in the header costs money and discarding it increases the cost of the use of the bag.

It is therefore an object of this invention to provide a bag pack without a header. Headerless bag packs are also shown in my U.S. Pat. No. 5,575,393 but the top bags of this invention operate on a different principle. The bags of this invention have a supporting aperture or hole which is designed to tear directly upwardly toward the mouth or the top of the bag. The bags themselves in this bag pack are sealed together by a small seal of either hot seal or cold weld type preferably on opposite sides of the supporting aperture or hole so that when the user wishes to remove a bag from the bag pack supported on a bag pack holder he simply grasps the bottom of the top bag and pulls down and away from the bag holder and the bag is removed ready for use. When the bags are all used up there is nothing left to discard since there is no header on the bag pack.

SUMMARY OF THE INVENTION

In accordance with the present invention, there is provided a thermoplastic film bag pack which comprises a plurality of bags stacked in at least general registration in a lay flat condition.

Each of the bags includes a top wall and a bottom wall, gusetted side walls are sometimes provided, although they are not necessary, and heat sealed across the bottom of the front and rear walls and the side walls. Bags of this nature may be made from tubular stock which is cut at the desired areas to provide the size of bag needed and the bags are then heat sealed together to provide the bag pack. Alternatively, sheet or film material may be used to make the bags. As previously mentioned, most plastic bags are headered and include an upper header portion from which the bags are removed along a line of weakening. The bag pack of this invention has no header and therefore eliminates the problem of discarding unused plastic material.

The bag pack of this invention has an aperture adjacent the top or opening of the bag which is preferably in a tear drop like shape so that when pressure is applied to the bag as part of a bag pack suspended on a dispenser, the bag will tear in the direction of the top opening of the bag. The bag pack itself is held together by small weak seals, generally two seals, which are on opposite sides of the aperture and adjacent the bottom thereof although the seals may be placed in any convenient location along or near the top of the bag so long as they maintain the bag in a bag pack condition. Either heat seals or cold weld seals are useable.

The cold seal is formed by protruding a dull pointed pin/needle of approximately ⅛" diameter through the pack and into a rubber pad or some other similar material. This action acts to extrude one bag through to the other and thus temporarily welding the bags together. The rubber has to be of sufficient durometer (70 minimum) as not to deform downwardly when the pin/needle is protruded into the pad.

The hot seal uses a very small diameter pin approximately 1/16" diameter that is heated to an appropriate temperature, for the material used, to melt and seal. This action is in conjunction with the action of extruding the material of the bag as the pin protrudes through into a Teflon pad. This Teflon paid is necessary as the rubber would burn or melt at the temperatures required to seal most bag materials. This seal, if tiny as stated above, will also only create a temporary seal that takes little force to separate once on a dispenser.

These temporary seals will allow the bag pack to be loaded onto the dispenser in a predetermined number without the unnecessary fumbling with loose bags. Once on the dispenser minimal force is necessary to separate the bags at the point of the seal while leaving the others still welded together. The seals in combination with the teardrop shaped mounting hole leaves no scrap once all the bags are removed.

In one method of preparing the bag packs of this invention, tubular stock is cut into the desired length to provide the size of bag required and the bags are then heat sealed together in a simple operation to provide the preferred double heat seals. The teardrop shaped hole is then punched through the bag pack. In use, the bag pack is simply suspended from a bag dispenser, which is normally a rod, and they are used by simply grasping the bottom of the bag on top of the pack and pulling it from the dispenser by breaking the seals and tearing through the teardrop shaped hole in the direction of the mouth or opening of the bag.

It is therefore an object of the present invention to provide a pack of thermoplastic film bags which are headerless and which are sealed together, either heat or cold seals, adjacent the top of the bag and have a teardrop shaped supporting hole which is designed to allow the bag to tear off from a support rod in the direction of the mouth of the bag thereby providing a useable bag with minimum waste.

Other objects and advantages of the present invention will become apparent to those skilled in the art upon the reading of the specification and the claims appended hereto.

DETAILED DESCRIPTION OF THE INVENTION

Figure 1:
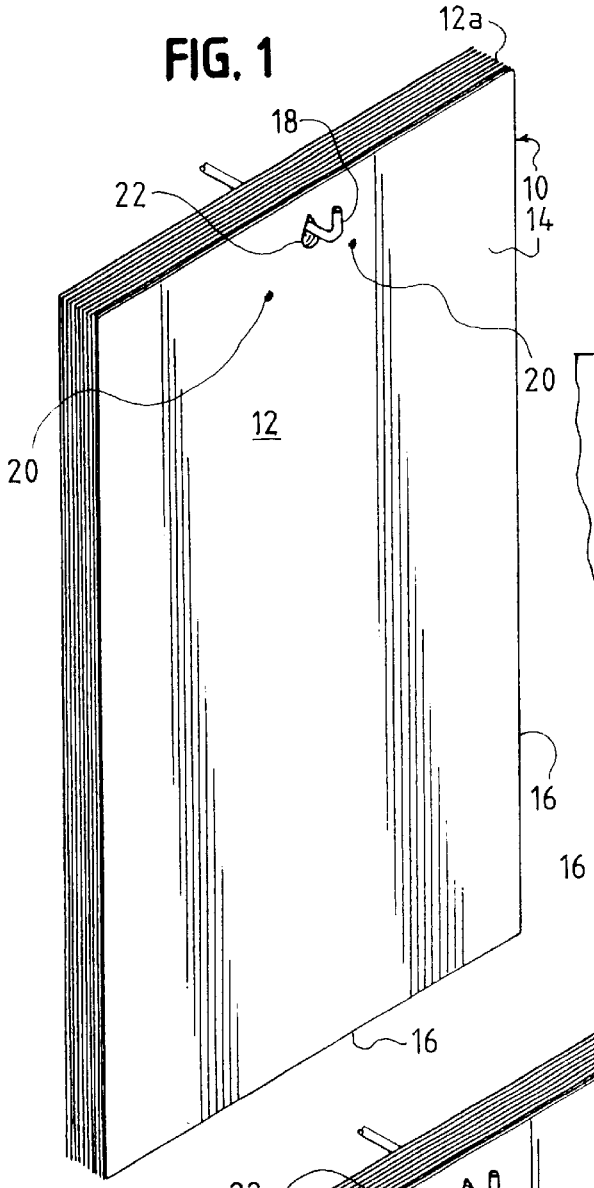
FIG. 1 is a perspective view of the bag pack of this invention supported on a dispenser rod which passes through the teardrop shaped hole.
Figure 2:
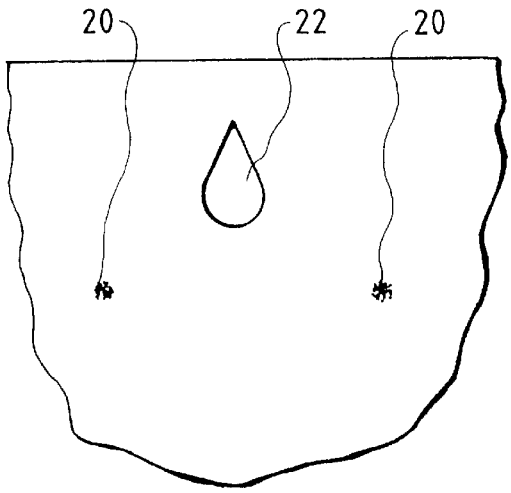
FIG. 2 is a front plan view greatly enlarged and broken away around the teardrop shaped hole and the seals.
Figure 3:
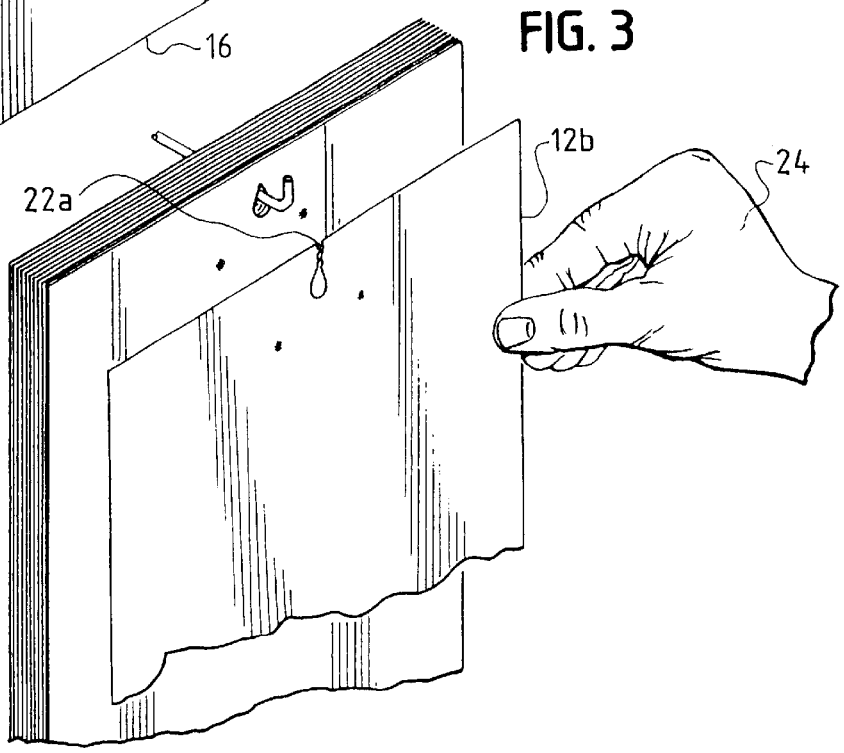
FIG. 3 is a partial perspective view showing a bag being removed from the bag pack of this invention.

The bag pack 10 of this invention is shown in perspective in FIG. 1. It is composed of a plurality of bags 12 which are conventional in construction, having a top wall 14 and a rear wall (not shown) of commensurate size to the top wall 14. The bags are heat sealed 16 along the sides and bottom and may include gussets (not shown) in the side walls.

The bags are made of a thermoplastic material of a limited thickness so that the bags may be easily removed from the dispenser rod 18.

The bags and the bag pack are heat or cold sealed at 20 to each other. The seals 20 themselves are small and do not require much force to break them. The bags are each provided with a teardrop shaped hole 22 which allows the bag pack to be suspended from the dispenser rod 18.

As previously explained, conventional bag packs normally include a header which would be located above the top of the bags shown in FIG. 1 at 12*a*. The header would be attached to the bags in the bag pack by a line of weakening so that the bags could then be torn off for use. The construction of the bag pack of this invention does not require a header and therefore, it has no wasted plastic material, and it is easily removed from the dispenser because of the construction of the seals and the teardrop shaped hole. The user 24 simply grabs the side of the bag 12*b*, pulls down and away from the dispenser. The shape of the teardrop shaped hole readily directs the bag to tear in the direction of the adjacent top of the bag 22*a* and the seals are not strong enough to prevent the removal of the bag so that the bag is readily pulled away from the pack open for use.

The size and shape of the bag, of course, depends upon the use to which the bag is to be put and variations in size and shape would have no bearing on the construction of the seals and the teardrop hole. Larger bags might require heavier thermoplastic film.

Various features of the invention have been particularly shown and described in connection with the illustrated embodiments of the invention, however, it must be understood that these particular arrangements merely illustrate and that the invention is to be given its fullest interpretation within the terms of the appended claims.

What is claimed is:

1. A headerless plastic bag pack comprising:

a) a plurality of generally congruent plastic film bags each having an open top, a bottom, a front wall and a rear wall, said walls having sides, and bottom, and top, and sealed together at the sides and bottom and open at the top to create a chamber therebetween to receive one or more products;

b) said walls of each bag being held one to another and to the walls of adjacent bags to provide said pack, by small easily broken seals of easily detachable strength adjacent the top of said bags;

c) each of said bags having a tear-drop shaped support opening adapted to receive a bag supporting rod and designed to tear substantially directly upward toward said open top of the bag when a downward removing force is applied to break said seals;

d) said support opening being located centrally and adjacent said seals and the top of said bag;

e) whereby minimal downward force applied by the user will break said seals and cause said bag to tear upwardly toward and through said open top and from aid supporting rod to make said bag available for use.

2. The bag pack of claim 1 wherein said seals are cold seals.

3. The bag pack of claim 1 wherein said seals are hot seals.

4. A headerless plastic bag comprising:

a) a plurality of generally congruent plastic film bags each having an open top, a bottom, a front wall and a rear wall, said walls having sides, and bottom, and top, and sealed together at the sides and bottom and open at the top to create a chamber there between to receive one or more products;

b) said bags arranged in the pack adjacent to one another whereby a wall of a bag is adjacent to a wall of another bag;

c) small easily broken seals holding said front wall of a bag to said rear wall of the same bag;

d) small easily broken seals holding a wall of one bag to a wall of an adjacent bag; and e) each of said bags having a tear drop shaped support opening adapted to receive a bag supporting rod and designed to tear substantially directly upward toward said open top of the bag when a downward removing force is applied to break said seals.

5. A headerless plastic bag pack as in claim 4, wherein said support opening is located centrally and adjacent said seals and the top of said bag.

6. The headerless plastic bag pack as in claim 4, wherein said seals are located near the top of said bags.

7. The headerless plastic bag pack as in claim 4, whereby minimal downward force applied by the user will break said seals and cause said bag to tear upwardly toward and through said open top and from said supporting rod to make said bag available for use.

8. The headerless plastic bag pack as in claim 4, wherein each of said front wall and rear wall of a bag has a support opening.

9. A headerless plastic bag comprising:

a) a plurality of generally congruent plastic film bags each having an open top, a bottom, a front wall and a rear wall, said walls having sides, and bottom, and top, and sealed together at the sides and bottom and open at the top to create a chamber there between to receive one or more products;

b) said bags arranged in the pack adjacent to one another whereby a wall of a bag is adjacent to a wall of another bag;

c) small easily broken seals holding said front wall of a bag to said rear wall of the same bag;

d) small easily broken seals holding a wall of one bag to a wall of an adjacent bag; and e) each of said bags having a support opening, located centrally and adjacent said seals and the top of said bag, adapted to receive a bag supporting rod and designed to tear substantially directly upward toward said open top of the bag when a downward removing force is applied to break said seals.

10. The headerless plastic bag pack as in claim 9, wherein said seals are located near the top of said bag.

11. The headerless plastic bag pack as in claim 9, whereby minimal downward force applied by the user will break said seals and cause said bag to tear upwardly toward and through said open top and from said supporting rod to make said bag available for use.

12. The headerless plastic bag pack as in claim 9, wherein each of said front wall and rear wall of a bag has a support opening.

13. A plastic bag pack made by the process of:

a) constructing a plurality of plastic bags welded at the bottom and sides and open at the top;

b) piling said bags in congruent relationship;

c) sealing said bags together by small easily broken seals; and d) punching a teardrop shaped support opening through said bags in an area adjacent said seals and the top opening of said bag.

14. The product of claim 13 wherein said seals are made by protruding a needle through said piled bags and into an absorbing surface.

15. The product of claim 14 wherein said needle is heated and said surface is a Teflon pad.

16. The product of claim 14 wherein said needle is cold and said surface is a rubbery material.

* * * * *